US007306438B2

(12) United States Patent
Kang et al.

(10) Patent No.: US 7,306,438 B2
(45) Date of Patent: Dec. 11, 2007

(54) SUCTION GAS GUIDING SYSTEM FOR RECIPROCATING COMPRESSOR

(75) Inventors: Kyung-Seok Kang, Kimhae (KR); Sung-Tae Woo, Busan (KR); Seong-Yeol Hyeon, Changwon (KR)

(73) Assignee: LG Electronics Inc. (KR)

( * ) Notice: Subject to any disclaimer, the term of this patent is extended or adjusted under 35 U.S.C. 154(b) by 505 days.

(21) Appl. No.: 10/474,787

(22) PCT Filed: May 25, 2001

(86) PCT No.: PCT/KR01/00878

§ 371 (c)(1),
(2), (4) Date: Oct. 14, 2003

(87) PCT Pub. No.: WO02/084121

PCT Pub. Date: Oct. 24, 2002

(65) Prior Publication Data

US 2005/0053488 A1 Mar. 10, 2005

(30) Foreign Application Priority Data

Apr. 16, 2001 (KR) ..... 2001-20203

(51) Int. Cl.
*F04B 39/00* (2006.01)
*F04B 53/00* (2006.01)
*F02M 35/00* (2006.01)

(52) U.S. Cl. ..... 417/417; 417/312; 181/229; 181/403

(58) Field of Classification Search ..... 417/417, 417/312; 181/229, 403
See application file for complete search history.

(56) References Cited

U.S. PATENT DOCUMENTS 5,993,178 A 11/1999 Park (Continued)

FOREIGN PATENT DOCUMENTS

JP 50-85815 7/1975

(Continued)

OTHER PUBLICATIONS

International Search Report.

(Continued)

*Primary Examiner*—Anthony D. Stashick
*Assistant Examiner*—Patrick Hamo
(74) *Attorney, Agent, or Firm*—Ostrolenk, Faber, Gerb & Soffen, LLP

(57) ABSTRACT

A suction gas guide system (100) for reciprocating compressor (30) comprises a gas guide conduit having both ends installed on a suction pipe (SP) of a shell (10) and on an inner flowing passage of a piston (31) so as to face each other and guiding sucked gas inside the shell (10) to the inner flowing passage of the piston (31), whereby a refrigerant gas is sucked into the gas flowing passage of the piston (31) through the gas guide conduit (100) smoothly. Accordingly, suction rate of the refrigerant gas is increased, moreover, noise and vibration generated during suction of the refrigerant gas are reduced, and therefore flow resistance for the noise and the sucked gas is reduced, whereby the reliability and efficiency of the compressor is increased. Also, the pre-heating of the gas by the motor (20) is prevented, and then increase of the specific volume of the gas is prevented, and thereby the efficiency of the compressor (30) is increased.

22 Claims, 11 Drawing Sheets

U.S. PATENT DOCUMENTS

| | | | | |
|---|---|---|---|---|
| 6,089,836 | A * | 7/2000 | Seo | 417/417 |
| 6,129,522 | A * | 10/2000 | Seo | 417/312 |
| 6,174,141 | B1 * | 1/2001 | Song et al. | 417/312 |
| 6,220,050 | B1 * | 4/2001 | Cooksey | 62/503 |
| 6,398,523 | B1 * | 6/2002 | Hur et al. | 417/417 |

FOREIGN PATENT DOCUMENTS

| | | |
|---|---|---|
| JP | 2001-073943 | 3/2001 |
| JP | 2001-73943 | 3/2001 |

OTHER PUBLICATIONS

Search Report issued by European Patent Office on Nov. 9, 2004 in connection with corresponding European patent application No. 01934589.1.

Office Action issued by Japanese Patent Office on Aug. 1, 2006 in connection with corresponding Japanese patent application No. 2002-581839.

* cited by examiner

FIG. 1 - PRIOR ART

SUCTION GAS GUIDING SYSTEM FOR RECIPROCATING COMPRESSOR

TECHNICAL FIELD

The present invention relates to a suction gas guiding system for a reciprocating compressor, and particularly, to a suction gas guiding system for a reciprocating compressor which is suitable for introducing suction gas into a compressor unit smoothly, and for reducing suction noise in case of installing the compressor unit inside a reciprocating motor.

BACKGROUND ART

Generally, a reciprocating compressor can be divided into a compressor which compresses and discharges the sucked gas by changing a rotating movement of a driving motor into a reciprocating motion of a piston, and a compressor which compresses and discharges the sucked gas by making the piston undergo reciprocating movement while the driving motor undergoes linear reciprocating movement.

FIG. 1 is a transverse cross-sectional view showing an embodiment of the reciprocating compressor in which the driving motor undergoes the linear reciprocating movement.

As shown therein, a conventional reciprocating compressor comprises a shell 10 in which a suction pipe (SP) and a discharge conduit (DP) are communicated with each other; a reciprocating motor 20 fixed inside the shell 10; a compressor unit 30 installed inside the reciprocating motor 10, sucking, compressing, and discharging gas; a frame unit 40 supporting the reciprocating motor 20 and the compressor unit 30; and a spring unit 50 elastically supporting an armature 22 of the reciprocating motor 20 in motion direction and guiding a resonance.

The reciprocating motor 20 includes a stator 21 including an inner stator 21A and an outer stator 21B, and an armature 22 disposed in a gap between the inner stator 21A and the outer stator 21B and undergoing a reciprocating movement.

The compressor unit 30 comprises a piston 31 coupled to a magnet supporting member 22A of the reciprocating motor 20 and undergoing the reciprocating movement together with the magnet supporting member 22A; a cylinder 32 fixed on a front frame 41 which will be described later, and forming a compressing space with the piston; a suction valve 33 installed on front end of the piston and restricting the suction of gas by opening/closing a gas passing hole 31*b* of the piston which will be described later; and a discharge valve assembly 34 disposed on the front end of the cylinder 32, whereby covering the compressing space, and restricting the discharge of compressed gas.

An inner flowing passage 31*a* communicating with the suction pipe (SP) is formed to a certain depth inside the piston 31, and the gas passing hole 31*b* communicated with the inner flowing passage 31*a* and penetrated to front end surface of the piston 31 is formed.

The frame unit 40 includes a front frame 41 contacting to front surfaces of the inner stator 21A and of the outer stator 21B, whereby supporting the stators together, and in which the cylinder 32 is inserted; a middle frame 42 contacting to rear surface of the outer stator 21B, whereby supporting the outer stator 21B; and a rear frame 43 coupled to the middle frame 42 and supporting rear end of a rear spring 52 which will be described later.

The spring unit 50 includes front spring 51 having both ends supported by the front surface of coupled part of the magnet supporting member 22A and the piston 31 and by the corresponding inner surface of the front frame 41, and a rear spring 52 having both ends supported by rear surface of the coupled part of the magnet supporting member 22A and the piston 31, and by corresponding front surface of the rear frame 43.

Reference numeral 22B designates a magnet.

The conventional reciprocating compressor as described above is operated as follows.

That is, when an electric current is applied to the winding coil 21C installed on the outer stator 21B of the reciprocating motor 20 and a flux is generated between the inner stator 21A and the outer stator 21B, whereby the armature 22 located in the gap between the inner stator 21A and the outer stator 21B moves in accordance with the direction of the flux and undergoes reciprocating movement by the spring unit 50. And accordingly, the piston 31 coupled to the armature 22 undergoes reciprocating movement inside the cylinder 32, so that a volume variance is generated inside the compressing space, accordingly the refrigerant gas is sucked into the compressing space, then compressed and discharged.

The refrigerant gas is sucked inside the shell 10 through the suction pipe (SP) during the suction stroke of the piston, and the gas is sucked into the compressing space of the cylinder 32 as opening the suction valve 33 through the inner flowing passage 31*a* of the piston 31 and through the gas passing hole 31*b*. Then, the gas is compressed to a certain level during the compress stroke of the piston, and discharged through the discharge conduit 34 as opening the discharge valve assembly 34. And the whole process is repeated.

However, in the conventional reciprocating compressor as described above, the refrigerant gas sucked into the shell 10 through the suction pipe (SP) is dispersed inside the shell 10, whereby the density per unit volume is lowered. Accordingly, the actual amount of refrigerant gas sucked into the compressing space during the reciprocating movement of the piston 31 is low, whereby the efficiency of the compressor is lowered.

Also, the refrigerant gas sucked into the shell 10 is pre-heated by contacting to the reciprocating motor 20 inside the shell 10, and then the gas is sucked into the compressing space. Therefore, the specific volume of the refrigerant gas is increased, and the performance of the compressor is lowered.

Also, when the suction valve 33 is opened/closed, the suction valve 33 is impacted to the front end surface of the piston 31, whereby the impact noise generated thereof is transferred to inside of the shell 10 entirely, and the noise of the entire compressor is increased.

In addition, when the suction valve 33 is opened/closed, the counter-flowing refrigerant gas is impacted with the sucked refrigerant gas instantaneously, whereby a pressure pulsation is generated. And the pressure pulsation is transferred to the suction pipe (SP) through the inner flowing passage 31*a* of the piston 31, and thereby the suction of the refrigerant gas is disturbed and the efficiency of the compressor is lowered.

DISCLOSURE OF THE INVENTION

Therefore, to solve the problems of the conventional art, it is an object of the present invention to provide a suction gas guide system for a reciprocating compressor which increase efficiency of the compressor by introducing sucked gas inside a shell to a compressing space, and thereby increasing a density of the refrigerant gas per unit volume.

Also it is an another object of the present invention to provide a suction gas guide system for a reciprocating compressor which is able to increase the efficiency of the compressor by preventing the sucked gas from being preheated before introduced into the compressing space and thereby preventing the increase of a specific volume of the gas.

In addition, it is still another object of the present invention to provide a suction gas guide system for a reciprocating compressor which is able to reduce the noise of the compressor by attenuating an impact noise generated from impact of the suction valve to a front end surface of the piston when the refrigerant gas is sucked.

Also it is still another object of the present invention to provide a suction gas guide system for a reciprocating compressor which is able to suck the refrigerant gas smoothly by attenuating a pressure pulsation generated from opening/closing of the suction valve.

To achieve these objects of the present invention, there is provided a reciprocating compressor including a shell in which a suction pipe and a discharge conduit are communicated with each other; a reciprocating motor including a stator comprising an inner stator and an outer stator which are fixed inside the shell having a certain air gap, and an armature disposed in the air gap between the two stators and undergoing a reciprocating movement; a compressor unit including a piston coupled to the armature of the reciprocating motor, undergoing the reciprocating movement together with the armature, and having an inner flowing passage is formed penetrating inside the piston, and a cylinder supported inside the reciprocating motor so as to form a compressing space by inserting the piston inside the cylinder; a frame unit supporting the reciprocating motor and the compressing unit; and a spring unit elastically supporting the armature of the reciprocating motor in motion direction, wherein a suction gas guide system including a gas guide conduit having both ends installed to oppose from each other in the suction pipe and in the inner flowing passage, and introducing the gas sucked into the shell through the suction pipe to the inner flowing passage of the piston is provided.

MODES FOR CARRYING OUT THE PREFERRED EMBODIMENTS

Hereinafter, the suction gas guide system of the reciprocating compressor according to the present invention will be described with reference to the accompanying drawings.

Figure 1:
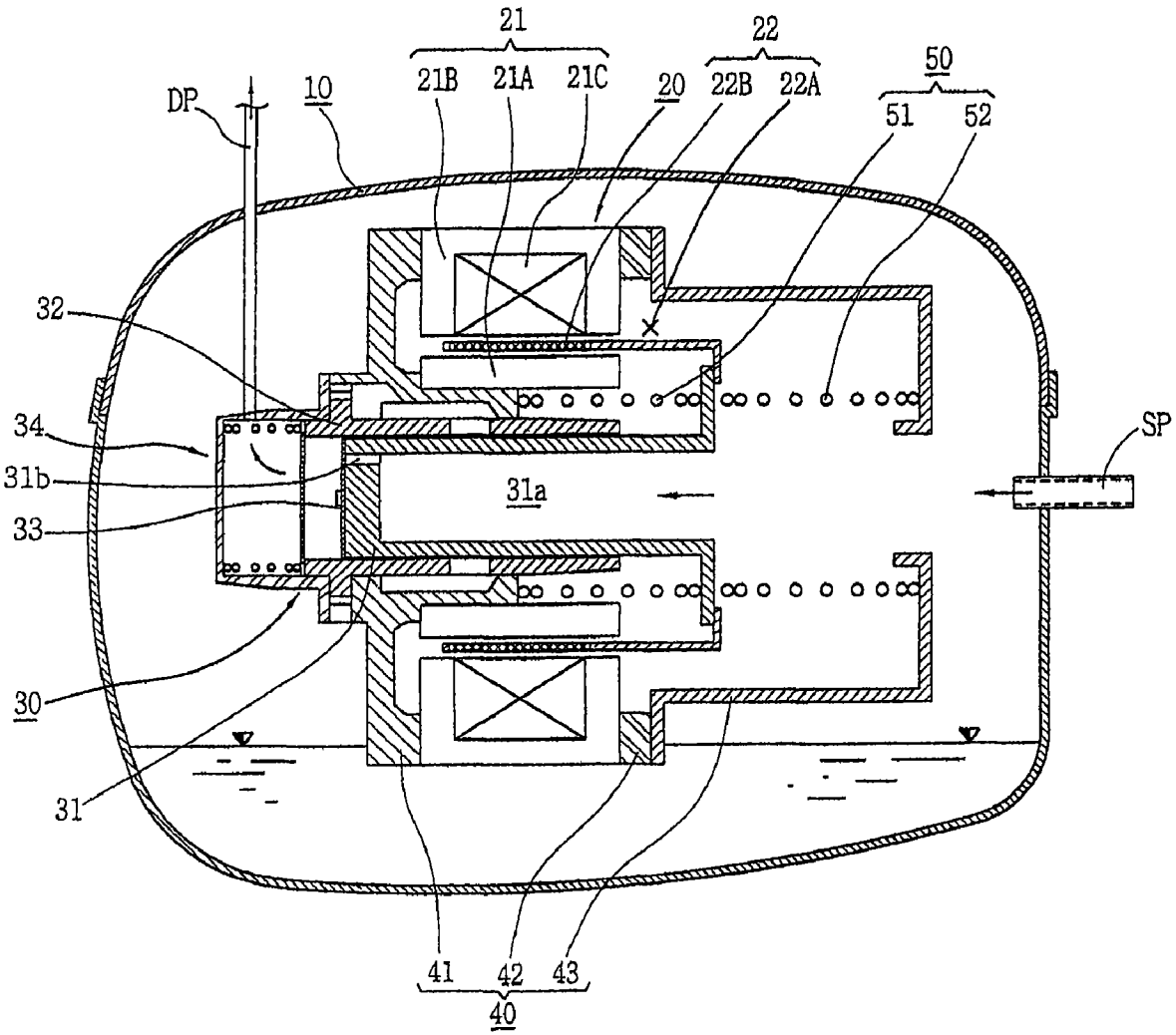
FIG. 1 is a transverse cross-sectional view showing a conventional reciprocating compressor.
Figure 2:
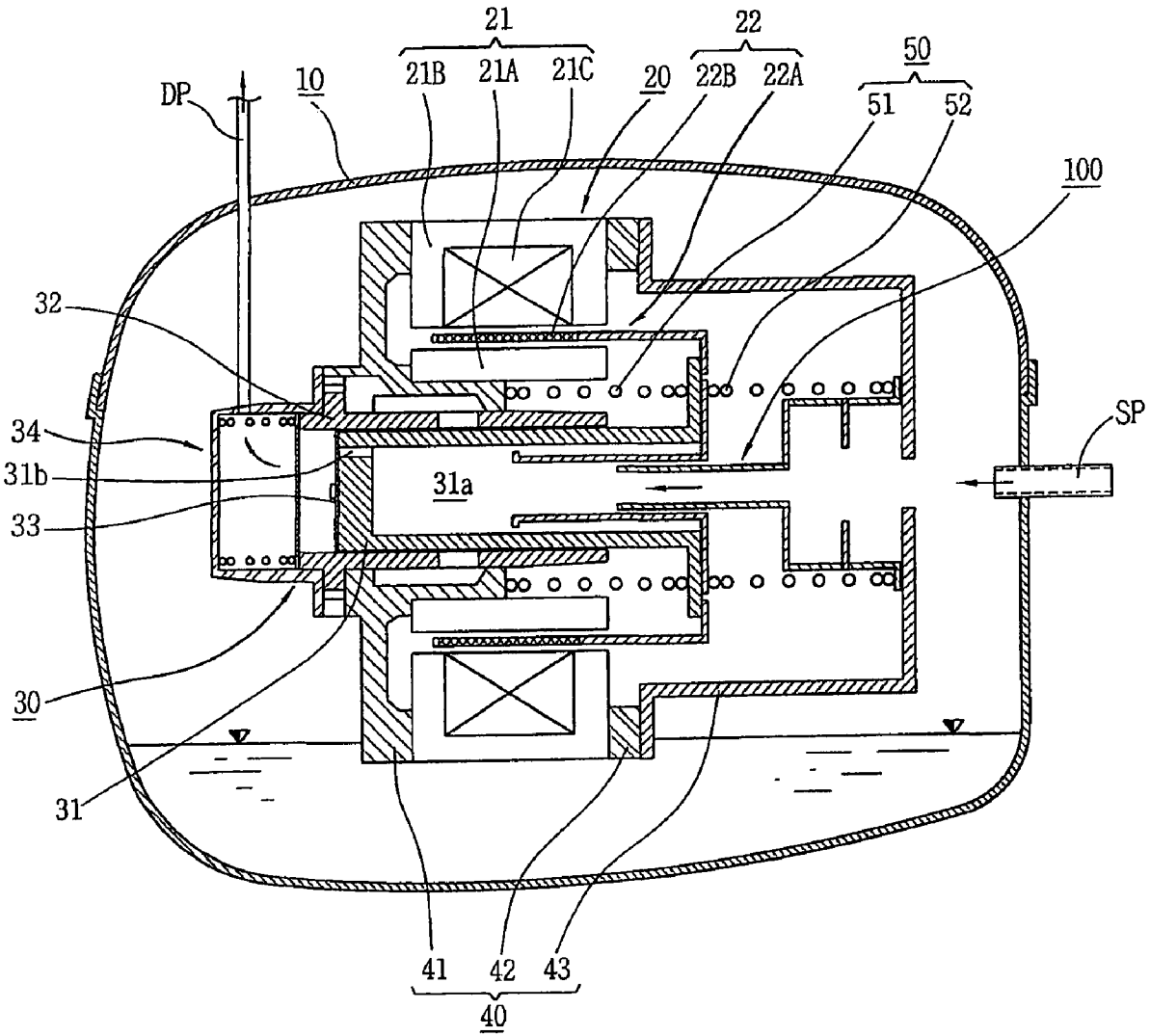
FIG. 2 is a transverse cross-sectional view showing a reciprocating compressor according to the present invention.

As shown in FIG. 2, the reciprocating compressor including the suction gas guide system according to the present invention comprises a shell 10 in which a suction pipe (SP) and a discharge conduit (DP) are communicated; a reciprocating motor 20 fixed inside the shell; a compressing unit 30 installed inside the reciprocating motor, sucking, compressing and discharging a gas; a frame unit 40 supporting the reciprocating motor 20 and the compressor unit 30; a spring unit 50 elastically supporting an armature 22 of the reciprocating motor 20 in a motion direction and guiding a resonance; and gas guide unit 100 installed between the compressing unit 30 and the frame unit 40, and guiding the sucked gas.

The reciprocating motor 20 includes a stator 21 comprising an inner stator 21A and an outer stator 21B, and an armature 22 disposed in an air gap generated between the inner stator 21A and the outer stator 21B and undergoing a reciprocating movement.

The compressor unit 30 includes a piston 31 coupled to the magnet supporting member 22A of the reciprocating motor 20, and undergoing reciprocating movement together; a cylinder 32 fixed to a front frame 41, which will be described later, so that the piston inserted into the cylinder slidably, and forming a compressing space with the piston; a suction valve 33 installed on the front end of the piston 31 and restricting suction of the gas by opening/closing a gas passing hole 31*b* of the piston 31, which will be described later; and a discharge valve assembly 34 installed on front end surface of the cylinder 32, covering the compressing space, and restricting discharge of the compressed gas.

An inner flowing passage 31*a* communicated with the suction pipe (SP) is formed to have a certain depth inside the piston 31, and a gas passing hole 31*b* communicating with the inner flowing passage 31*a* and penetrated to the front end surface of the piston is formed inside the piston 31.

The frame unit 40 includes a front frame 41 contacting to front surfaces of the inner stator 21A and of the outer stator 21B, whereby supporting the two stators together, and having a cylinder inserted and coupled to the front frame 41; a middle frame 42 contacting to the rear surface of the outer stator 21B and supporting the outer stator 21B; a rear frame 43 coupled to the middle frame 42 and supporting a rear end of a rear spring which will be described later.

The spring unit 50 includes a front spring 51 having both ends supported by a front surface of the coupled part of a magnet supporting member 22A and of the piston 31, and by an inner surface of the front frame 41, respectively; and a rear spring 52 having both ends supported by a rear surface of the coupled part of the magnet supporting member 22A and of the piston 31, and by a corresponding front surface of the rear frame 43, respectively.

The gas guide unit 100 may include a guide conduit, or may include two or more guide conduits. Herein, a gas guide unit including two guide conduits will be described.

Figure 3:
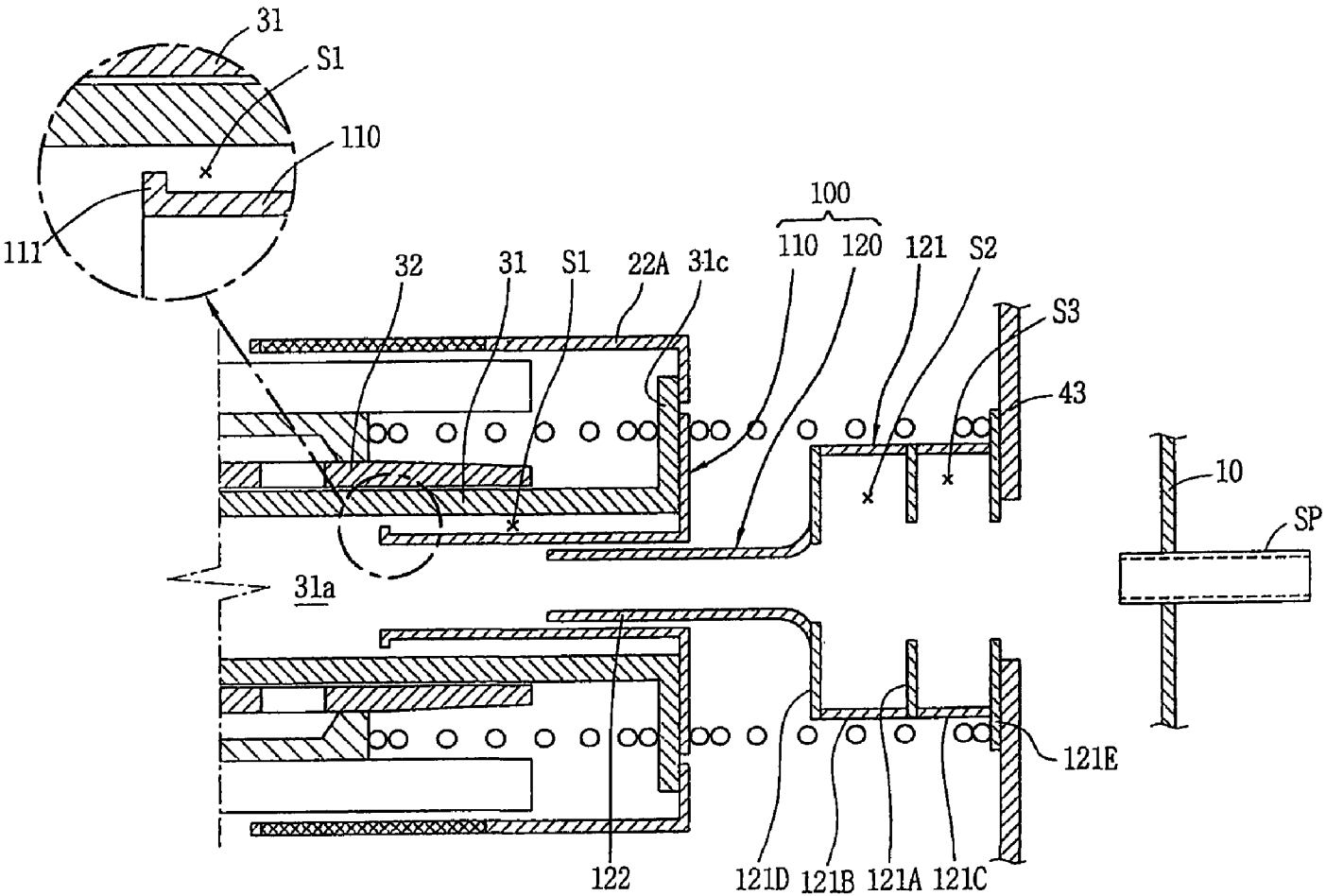
FIG. 3 is a transverse cross-sectional view showing the reciprocating compressor centering around a suction gas guide system according to the present invention.
Figure 4:
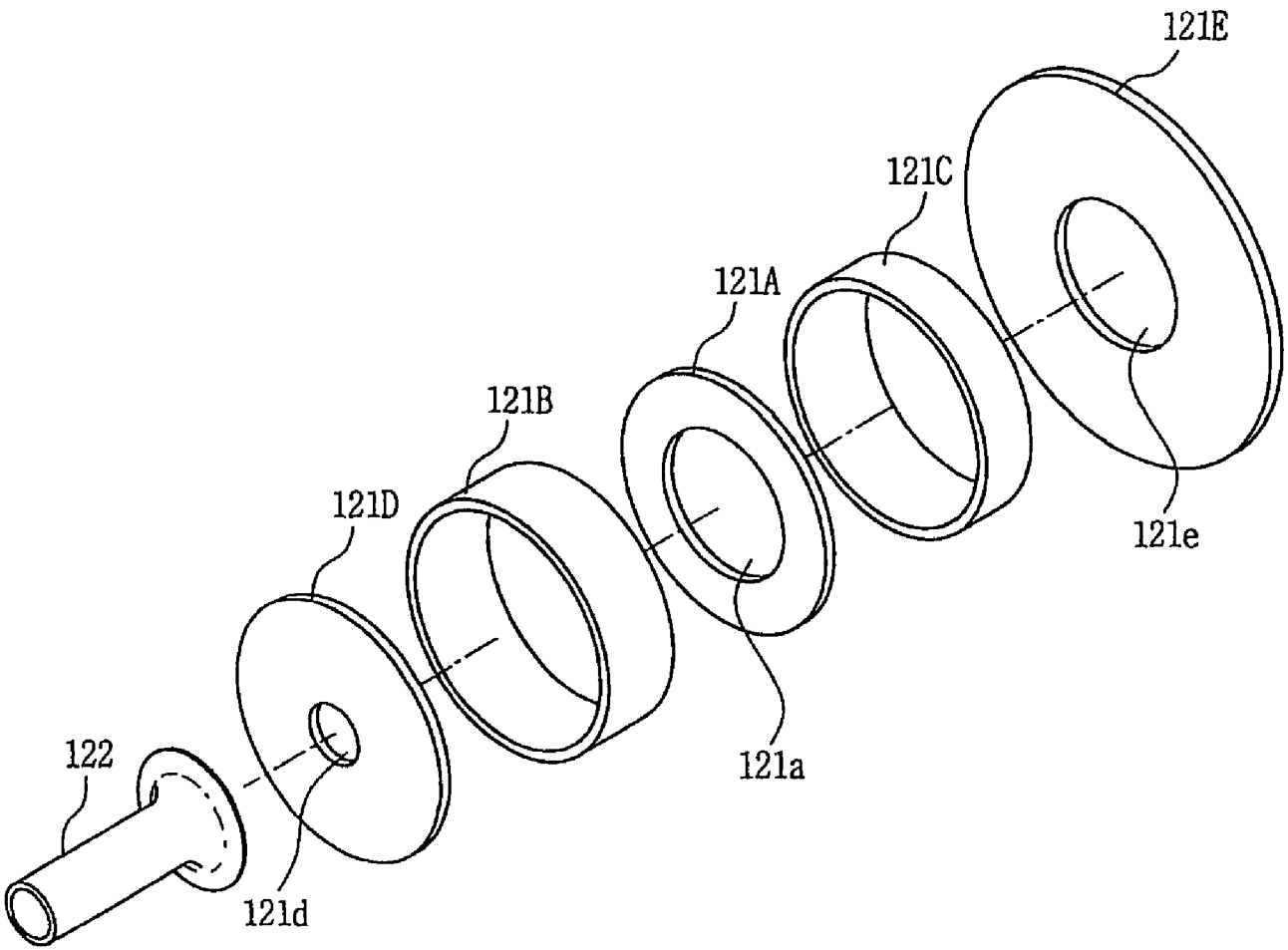
FIG. 4 is an exploded perspective view showing the suction gas guide system of the reciprocating compressor according to the present invention.

As shown in FIGS. 3 and 4, the gas guide unit 100 includes a first guide conduit 110 coupled to the piston 31 so as to be inserted into the inner flowing passage 31*a* of the piston 31; and a second guide conduit 120 inserted inside the first guide conduit 110 so that a front side of the second guide conduit 120 is overlapped at a certain range and coupled on a same axial line with the first guide conduit.

The first guide conduit 110 is fixedly screwed using a volt (not shown) on a flange unit 31*c* formed on rear end of the piston 31 so as to be coupled to the magnet supporting member 22A, and the second guide conduit 120 is fixedly screwed using a volt (not shown) on an inner surface of the rear frame 43 of the frame unit 40.

An outer diameter of the first guide conduit 110 is formed shorter than an inner diameter of the inner flowing passage 31*a* of the piston, so that there is a first resonant space (S1) between the outer surface of the first guide conduit 110 and the corresponding inner surface of the piston 31. In addition, the rear end of the first guide conduit 110 abuts to the flange unit 31*c* formed on the rear end of the piston 31, but the front end of the first guide conduit 110 communicates with the inner flowing passage 31*a* because the length of the first guide conduit 110 is shorter than that of the entire inner flowing passage 31*a* formed inside the piston 31.

Also, on the front end of the first guide conduit 110, an outward flange unit 111 toward the inner circumferential wall of the inner flowing passage 31*a* so that the entrance of the first resonant space (S1) is stepped.

On the other hand, the second guide conduit 120 includes a large conduit unit 121 fixed to the rear frame 43, and a small conduit unit 122 coupled to the front side of the large conduit unit 121 and inserted into the first guide conduit 110.

The large conduit unit 121 includes a baffle unit 121A dividing the inside of the large conduit unit 121 into a plurality of resonant spaces (S2 and S3) is installed at least one (a baffle unit is shown in Figure), and it is desirable that the baffle unit 121A is installed in a vertical direction against the flowing direction of the gas.

Also, the large conduit unit 121 includes the baffle unit 121A; a first conduit unit 121B and a second conduit unit 121C forming a body with the baffle unit 121A and forming a second resonant space (S2) and a third resonant space (S3) by coupling both sides of the baffle unit 121A; and a first side plate unit 121D and a second side plate unit 121E coupling to the other sides of the first and second conduit unit 121B and 121C, respectively.

Outer diameters of the first conduit unit 121B and the second conduit unit 121C are formed same as those of the baffle unit 121A and the respective side plate units 121D and 121E, and bores 121*a*, 121*d*, and 121*e* are formed in a central part of the baffle unit 121A and of the respective side plate units 121D and 121E at the same axial line with those of the suction pipe (SP), the small conduit unit 122, and the inner flowing passage 31*a*.

The first side plate unit 121D is located on front side of the large conduit unit 121, in which the small conduit unit 122 is coupled on its bore 121*d*, and a flange unit (not defined as a reference numeral) coupled to the rear frame 43 is formed on the second side plate unit 121E.

Also, it is desirable that an inner edge of the entrance of the small conduit unit 122 is formed round. In addition, the first conduit unit 121B and the first side plate 121D may be formed as a single body, and the other members are able to be welded by an ultrasonic welding or a brazing method.

Same components as those of the conventional art are designated by the same reference numerals.

Reference numeral 22B designates a magnet.

The suction gas guide system of a reciprocating compressor according to the present invention has effects as follows.

That is, when an electric source is applied to the reciprocating motor 20, accordingly a flux is formed between the inner stator 21A and the outer stator 21B, whereby the armature 22 with the piston 31 moves in accordance with the direction of the flux and undergoes linear reciprocating movement by the spring unit 50. Then, the piston 31 coupled to the armature 22 undergoes the linear reciprocating movement inside the cylinder 32 so that a pressure variance is repeatedly generated inside the cylinder 32. Accordingly, due to the pressure variance inside the cylinder 32, the refrigerant gas is sucked into the compressing space of the cylinder 32 through the inner flowing passage 31*a* in the piston 31, then compressed and discharged. And this process is repeated.

Hereinafter, the process will be described in more detail.

Figure 5:
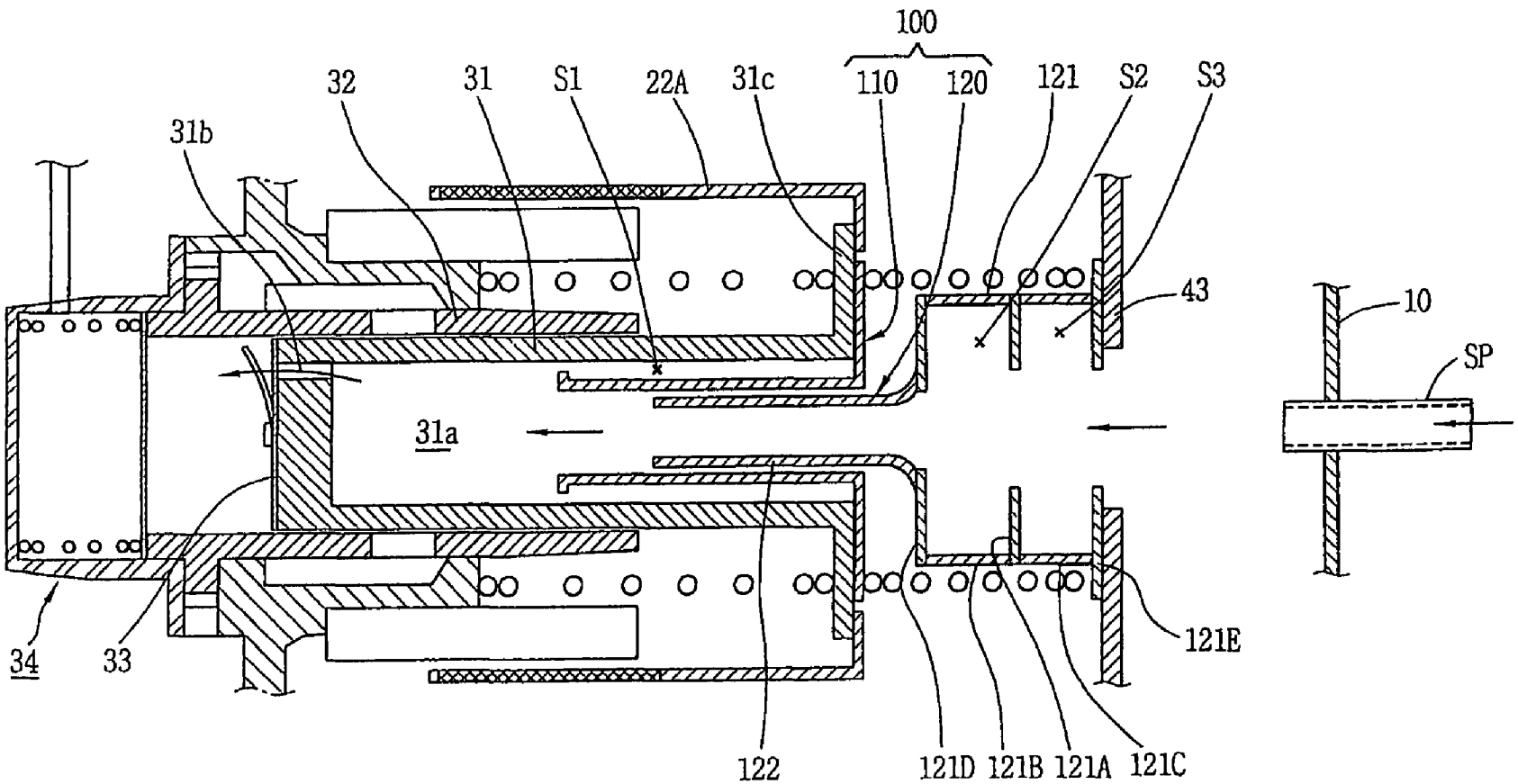
FIG. 5 is a transverse cross-sectional view showing an operating state of the reciprocating compressor according to the present invention.

First, as shown in FIG. 5, the refrigerant gas (indicated as the real line arrow in drawing) is sucked and charged inside the shell 10 through the suction pipe (SP) during the suction stroke of the piston 31, and after that, the refrigerant gas charged in the shell 10 is sucked into the compressing space of the cylinder 32 as opening the suction valve 33 through the large conduit unit 121 and the small conduit unit 122 of the second guide conduit 120, the first guide conduit 110, and the gas passing hole 31*b* on the inner flowing passage 31*a* of the piston 31 during the continued suction stroke of the piston 31.

At that time, before the refrigerant gas sucked into the shell 10 is dispersed entire shell 10, the gas is guided to the inner flowing passage 31*a* of the piston through the respective guide conduits 110 and 120, and the refrigerant gas guided into the inner flowing passage 31*a* is directly sucked into the compressing space as opening the suction valve 33 through the gas passing 31*b*, whereby the density of the gas per unit volume is increased, and therefore the efficiency of the compressor is able to be increased.

Also, as the refrigerant gas sucked into the shell 10 through the suction pipe (SP) is guided to the compressing space of the cylinder 32 through the gas guide unit 100, a direct contact of the gas to the motor can be prevented to a certain extent. And thereby increase of the specific volume of the refrigerant gas is able to be restrained, and accordingly, the amount of sucked gas is increased, whereby the efficiency of the compressor can be increased.

Also, the first guide conduit 110 and the second guide conduit 120 of the gas guide unit 100 are disposed to be overlapped always when the piston 31 undergoes the reciprocating movement, and therefore the leakage of the refrigerant gas during the suction of the gas is able to be reduced. Accordingly, the suction rate of the refrigerant gas is increased, whereby the efficiency of, the compressor also is able to be increased.

Also, the suction pipe (SP), the first guide conduit 110 and the second guide conduit 120 are disposed at the same axial line, especially, even though the large conduit unit 121 is located on the sucking side of the second guide conduit 120, the connecting part of the large conduit unit 121 and the small conduit unit 122 is formed as round, whereby the refrigerant gas is directly sucked into the compressing space of the cylinder 32 through the suction pipe (SP). Therefore, the suction rate of the refrigerant gas is increased, and the efficiency of the compressor can be increased.

Figure 6:
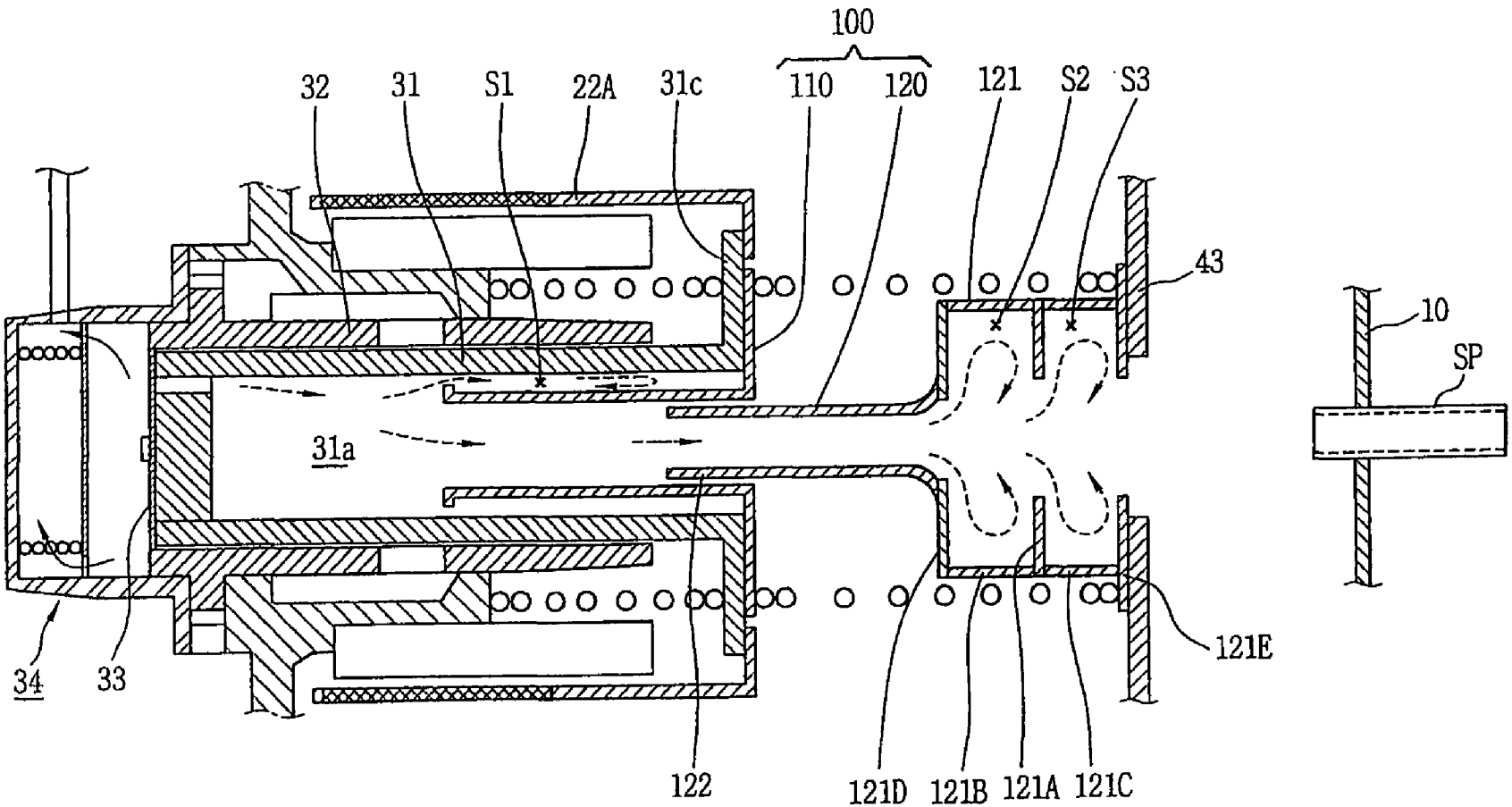
FIG. 6 is a transverse cross-sectional view showing an operating state of the reciprocating compressor according to the present invention.

After that, as shown in FIG. 6, the refrigerant gas in the compressing space of the cylinder 32 is compressed during the compressing stroke of the piston 31, and then the gas is discharged as opening the discharge valve 34.

At that time, the suction valve 33 opened during the suction of the refrigerant gas is closed, and then the suction valve 33 is impacted to the front surface of the piston 31, whereby an impact noise (indicated as dotted line arrows in drawing) between the valve 33 and the piston 31 is generated. And the noise is flows to the opposite of the suction direction of the gas, but the noise of low frequency is attenuated in the first resonant space (S1) formed between the inner flowing passage 31*a* of the piston and the first guide conduit 110, and the noise of high frequency is attenuated through the second resonant space (S2) and the third resonant space (S3) formed on the large conduit unit 121 in the second guide conduit 120, whereby the reliability of the compressor is increased.

Also, as the suction valve 33 is opened/closed, some of the refrigerant gas being sucked is counter flown, and accordingly the counter-flowing refrigerant gas causes a pressure pulsation by impact with the refrigerant gas being sucked through the inner flowing passage 31*a* of the piston 31. Then, the pressure pulsation disturbs the suction of the refrigerant gas by flowing to the opposite of the suction direction. However, the pressure pulsation is somewhat attenuated with the impact noise while flowing through the respective resonant space (S1, S2, and S3), whereby the amount of the refrigerant gas newly sucked is able to be increased, and the efficiency of the compressor can be increased.

In addition, the large conduit unit 121 is fixed on the rear frame 43 and does not move with the reciprocating movement of the piston 31, and therefore the flow resistance is restrained and the efficiency of the compressor is able to be increased.

Moreover, when the gas guide unit 100 is assembled, the large conduit unit 121 is molded as separated members and fabricated by the ultrasonic welding or by the brazing, and after that the large conduit unit 121 is assembled. Therefore the assembling process of the gas guide unit 100 is made in simple way, whereby the productivity can be increased.

Hereinafter, the another embodiment of the suction gas guide system for a reciprocating motor according to the present invention will be described.

In the embodiment described above, the first guide conduit 110 and the second guide conduit 120 are fixed on the piston 31 and on the frame 43 respectively as separate bodies. However, in the present embodiment as shown in FIG. 7, a first guide conduit 210 and a second guide conduit 220 may be fixed on the piston 31 together, or as shown in FIG. 8, a first guide conduit 310 and a second guide conduit 320 may be fixed on the frame 43 together.

Figure 7:
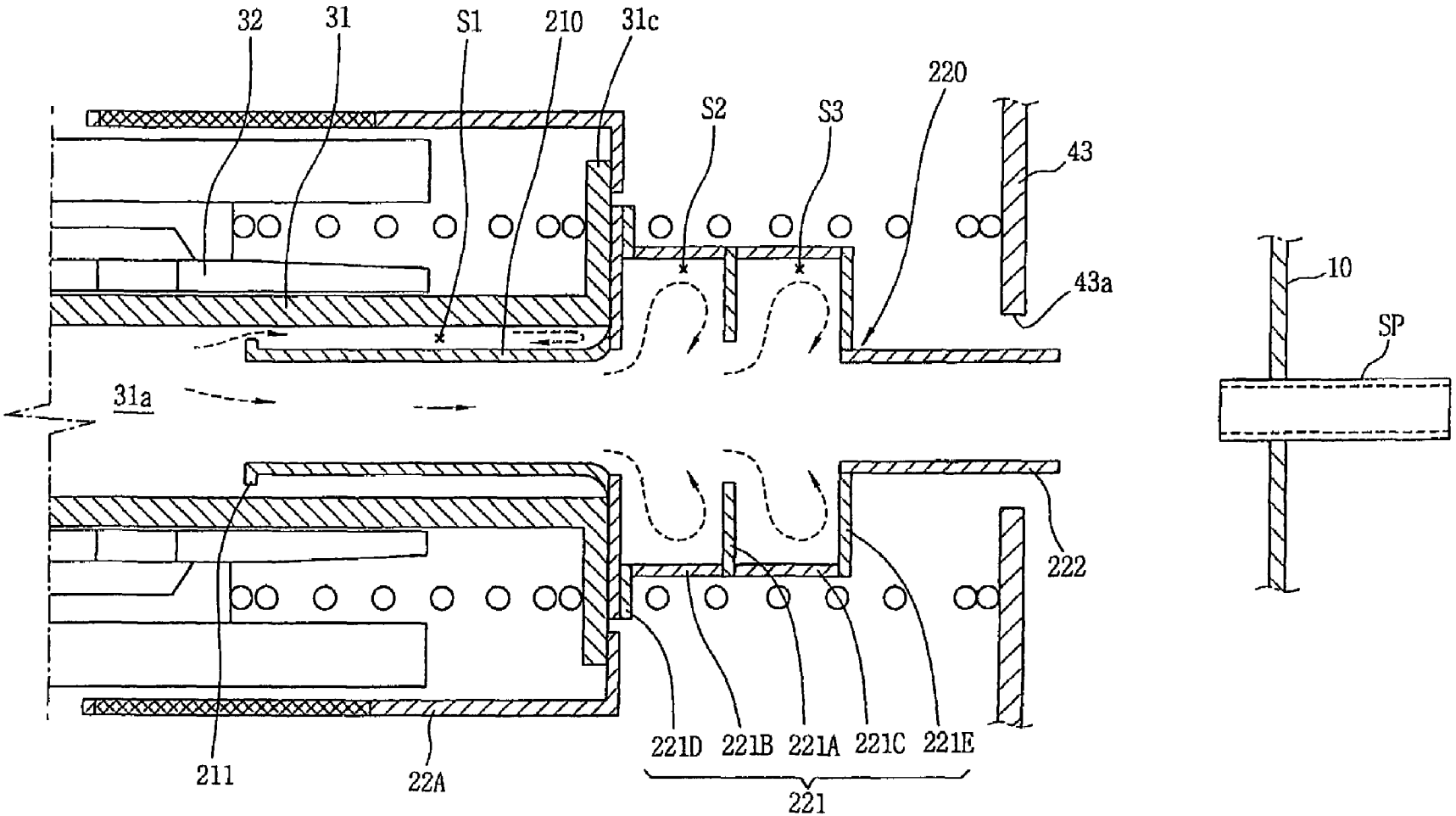
FIG. 7 is a transverse cross-sectional view showing an another embodiment of the suction gas guide system of the reciprocating compressor according to the present invention.
Figure 8:
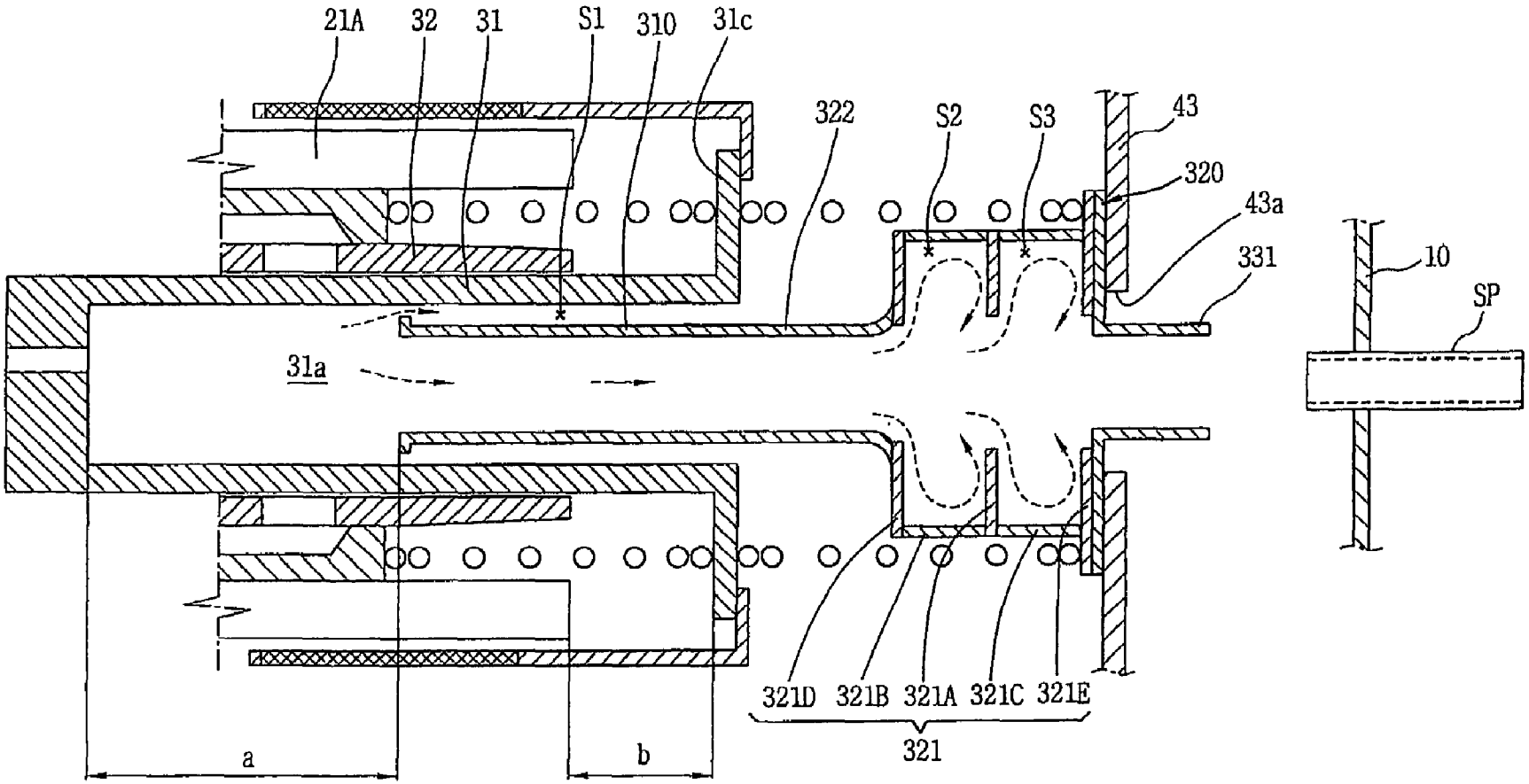
FIG. 8 is a transverse cross-sectional view showing an another embodiment of the suction gas guide system of the reciprocating compressor according to the present invention.

As for the embodiment shown in FIG. 7, in case that the first guide conduit 210 and the second guide conduit 220 are fixed on the piston 31, the first guide conduit 210 is formed extending forward so as to be inserted in the inner flowing passage 31*a*, and the second guide conduit 220 is formed extending backward so as to oppose against the suction pipe (SP) of the shell 10 and to be overlapped with the bore 43*a* included in the frame 43 in a certain range.

Also, the first guide conduit 210 is formed to have an outer diameter shorter than the inner diameter of the piston 31 so that the outer surface of the first guide conduit 210 and the inner surface of the piston 31 form the first resonant space (S1), and an outward flange unit 211 is formed on front end of the first guide conduit 210.

On the contrary, the said large conduit unit 221 is formed on the coupled part with the piston 31 of the second guide conduit 220, and the said baffle unit 221A is formed on the large conduit unit 221. As described in the above embodiment, the large conduit unit 221 includes the baffle unit 221A; a first conduit unit 221B and a second conduit unit 221C coupled on both sides of the baffle unit 221A whereby forming the second resonant space (S2) and the third resonant space (S3); and a first side plate unit 221D and a second side plate unit 221E coupled to the other sides of the first conduit unit 221B and the second conduit unit 221C.

Herein, it is desirable that the inner edge of the first guide conduit 210 entrance is formed roundly. In addition, in the large conduit unit 221 in the second guide conduit 220, the second conduit unit 221C and the second side plate unit 221E may be formed as a single body, and rest components can be able to be coupled by using ultrasonic welding or brazing.

As described above, in case that the first and second guide conduit 210 and 220 are all coupled to the piston 31, the first and second guide conduit 210 and 220 undergo the reciprocating movement along with that of the piston 31, whereby the conduits 210 and 220 guide the refrigerant gas sucked into the shell 10 to the compressing space of the cylinder 32. At this time, as the first and second guide conduit 21 and 220 are coupled together to the piston 31, the leakage of the refrigerant gas between the conduits 210 and 220 is prevented, and therefore the amount of sucked gas can be increased.

And the respective effects described in the above embodiment are similar with those of the present embodiment, and accordingly, the description for that is omitted.

As shown in FIG. 8, in case that the first guide conduit 310 and the second guide conduit 320 are all fixed on the frame 43, the large conduit unit 321 including the baffle unit 321A is formed on the first guide conduit 310, and a extended unit 331 may be formed on the second guide conduit 320 so as to be inserted in the bore 43*a* of the rear frame 43.

The first guide conduit 310 includes a large conduit unit 321 fixed on inner surface of the rear frame 43, and a small conduit unit 322 coupled to front side of the large conduit unit 321 and inserted into the inner flowing passage 31*a*.

Also, it is desirable that the first guide conduit 310 is always located inside the range of the inner flowing passage 31*a* when the piston 31 undergoes reciprocating movement, and the distance (a) from the end of the inner flowing passage 31*a* of the piston 31 to the front end of the small conduit unit 312 is shorter than the distance (b) between the rear side surface of the inner stator 21A and the inner surface of the magnet supporting member 22A because the first guide conduit 310 is fixed on the frame 43 apart from the piston 31.

The large conduit unit 321 includes the baffle unit 321A; a first conduit unit 321B and a second conduit unit 321C forming a body unit with the baffle unit 321A and coupled to both sides of the baffle unit 321A whereby forming the second resonant space (S2) and the third resonant space (S3); and a first side plate unit 321D and a second side plate unit 321E coupled to the other sides of the first and second conduit units 321B and 321C, respectively.

The first side plate unit 321D is located on front side of the large conduit unit 321 having a small conduit unit 322 coupled to its bore (not defined). And a flange unit (not defined) coupled to the rear frame 43 is formed on the second side plate unit 321E.

Also, the first conduit unit 321B and the first side plate unit 321D may be formed as a single body, and rest members may be welded and coupled by using ultrasonic welding or brazing method.

It is desirable that an inner edge of the entrance end of the small conduit unit 322 is formed roundly.

On the other hand, an extended unit 321 penetrating the rear frame 43 as described above is formed extending from the flange unit (not defined) fixed on the rear frame 43 in the second guide conduit 320.

In that case, the first and second guide conduits 310 and 320 are all fixed on the frame, that is, a fixed body, accordingly, the weight of the piston 31 as an armature is reduced, whereby the efficiency of the motor is increased, moreover, a flow resistance is reduced.

The present embodiment has similar structure and effects as those of the embodiments described above, and the descriptions for that will be omitted.

Hereinafter, the another embodiment of the present invention will be described.

Figure 9:
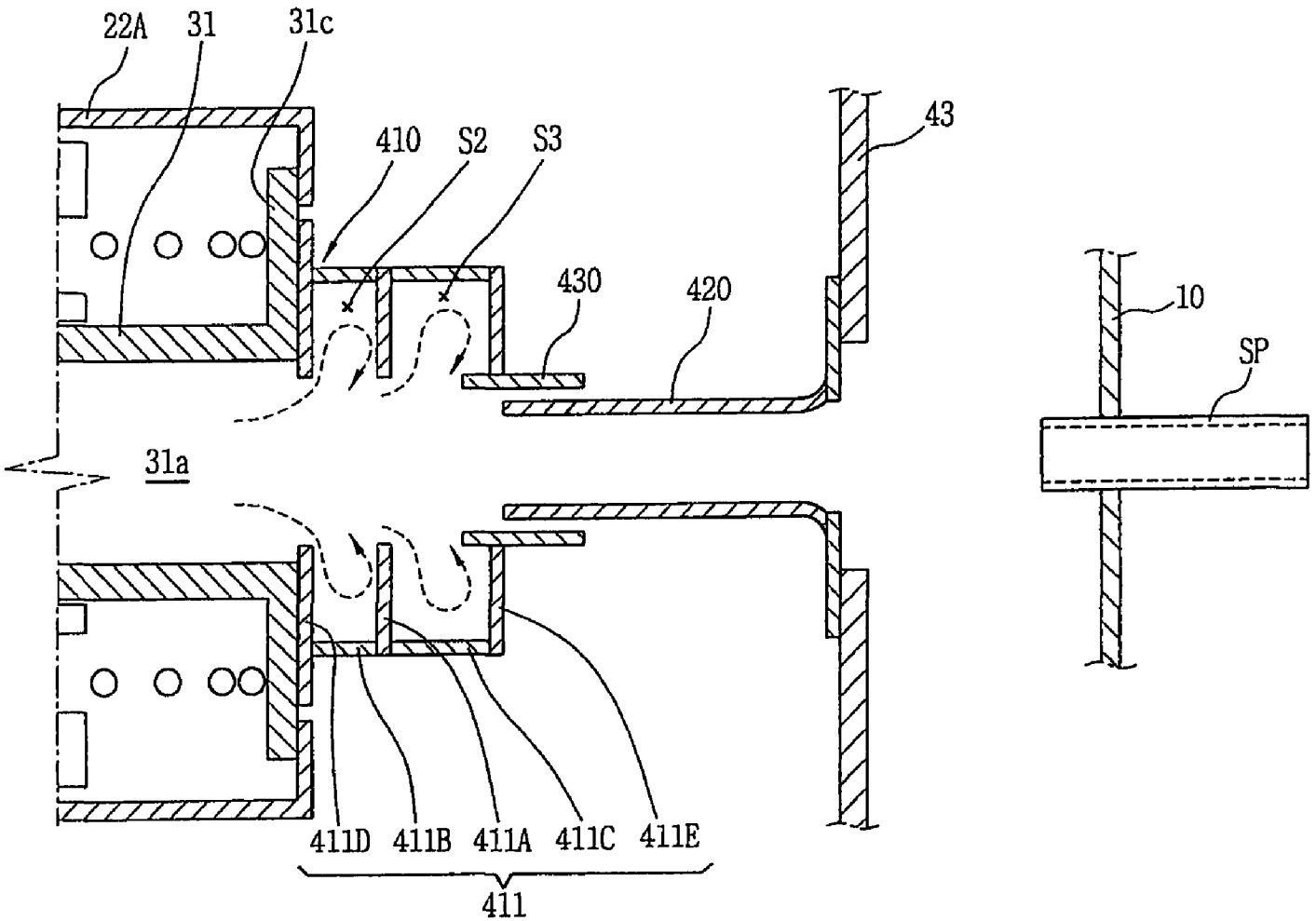
FIG. 9 is a transverse cross-sectional view showing an another embodiment of the suction gas guide system of the reciprocating compressor according to the present invention.

The gas guide unit in the embodiments described above includes the first guide conduit and the second guide conduit, however, in the present embodiment, the gas guide unit further includes an intermediate guide conduit between the first and second guide conduits. As shown in FIG. 9, the intermediate guide conduit 430 is installed on rear side of the first guide conduit 410 fixed on the piston 31, and the second guide conduit 420 inserted into the intermediate guide conduit 430 slidably is fixedly coupled to the frame 43.

The first guide conduit 410 is formed extending from the rear side of the piston 31 toward the frame 43, and a diameter of the first guide conduit 410 is formed larger than that of the inner flowing passage 31*a* of the piston 31 so as to perform as the large conduit unit 411.

A baffle unit 411A dividing inside of the first guide conduit 410 into a plurality of resonant spaces (S2 and S3) is located in intermediate part of the first guide conduit 410. In addition, the first conduit unit 411B and the second conduit unit 411C are installed on both sides of the baffle unit 411A, the first side plate unit 411D is installed on front surface of the first conduit unit 411B, and a connecting plate unit 411E forming the second side plate unit and connectively supporting the intermediate guide conduit 430 is installed on rear surface of the second conduit unit 41C.

It is desirable that the intermediate guide conduit 430 is installed at same axial line of the suction pipe (SP), the second guide conduit 420, and the inner flowing passage 31*a* of the piston 31.

Also, it is desirable that the inner diameter of the intermediate guide conduit 430 is formed larger than the outer diameter of the second guide conduit 420 so that the second guide conduit 420 is inserted into the intermediate guide conduit 430 slidably.

The rear end of the second guide conduit 420 is fixed on inner surface of the frame 43 and extended toward the piston 31, and the front end of the second guide conduit 420 is inserted so as to be overlapped with the middle guide conduit 430 always.

The effects of the present embodiment are similar with those of the embodiments described above, and therefore detailed descriptions for that are omitted.

Figure 10:
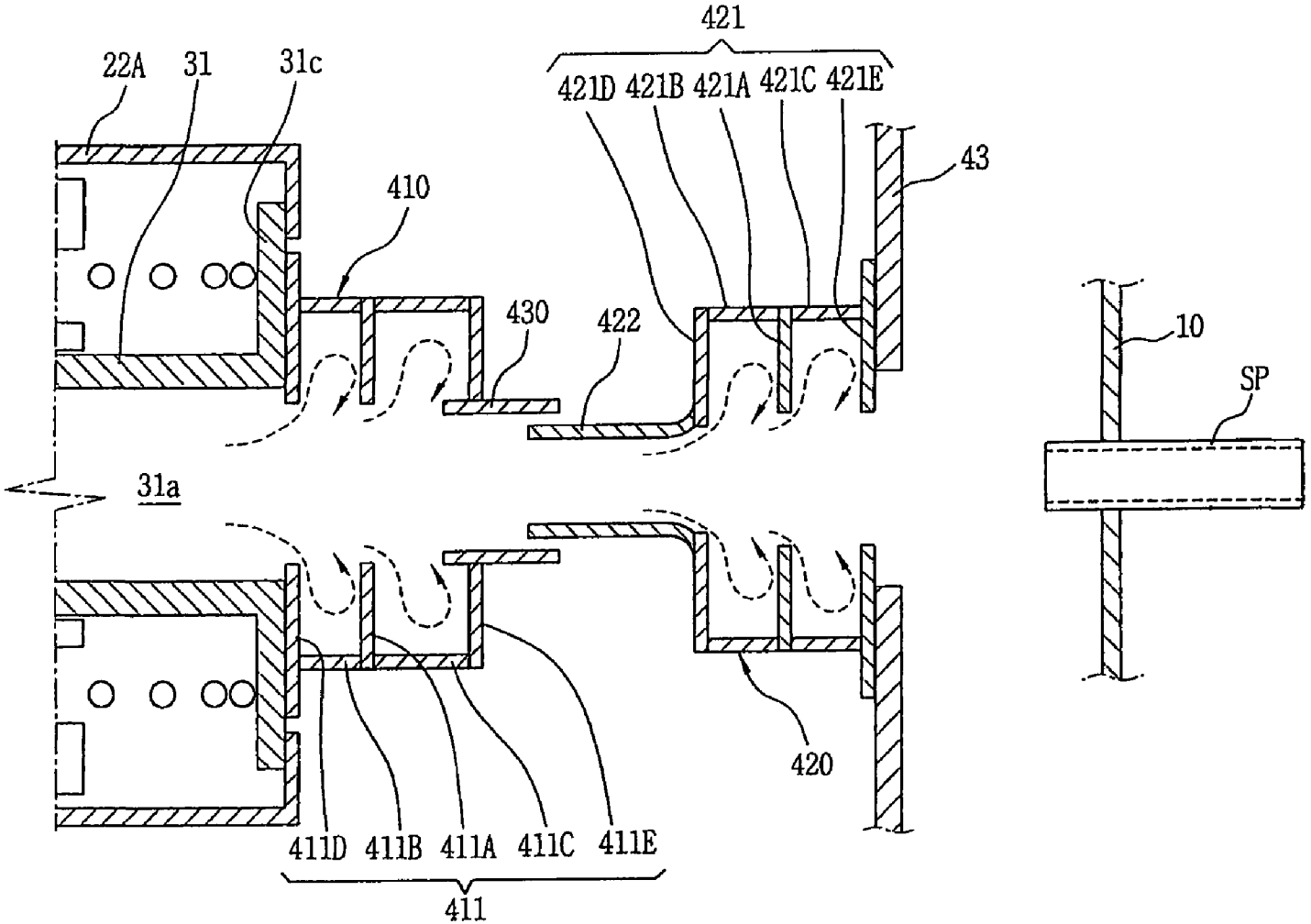
FIG. 10 is a transverse cross-sectional view showing an another embodiment of the suction gas guide system of the reciprocating compressor according to the present invention.
Figure 11:
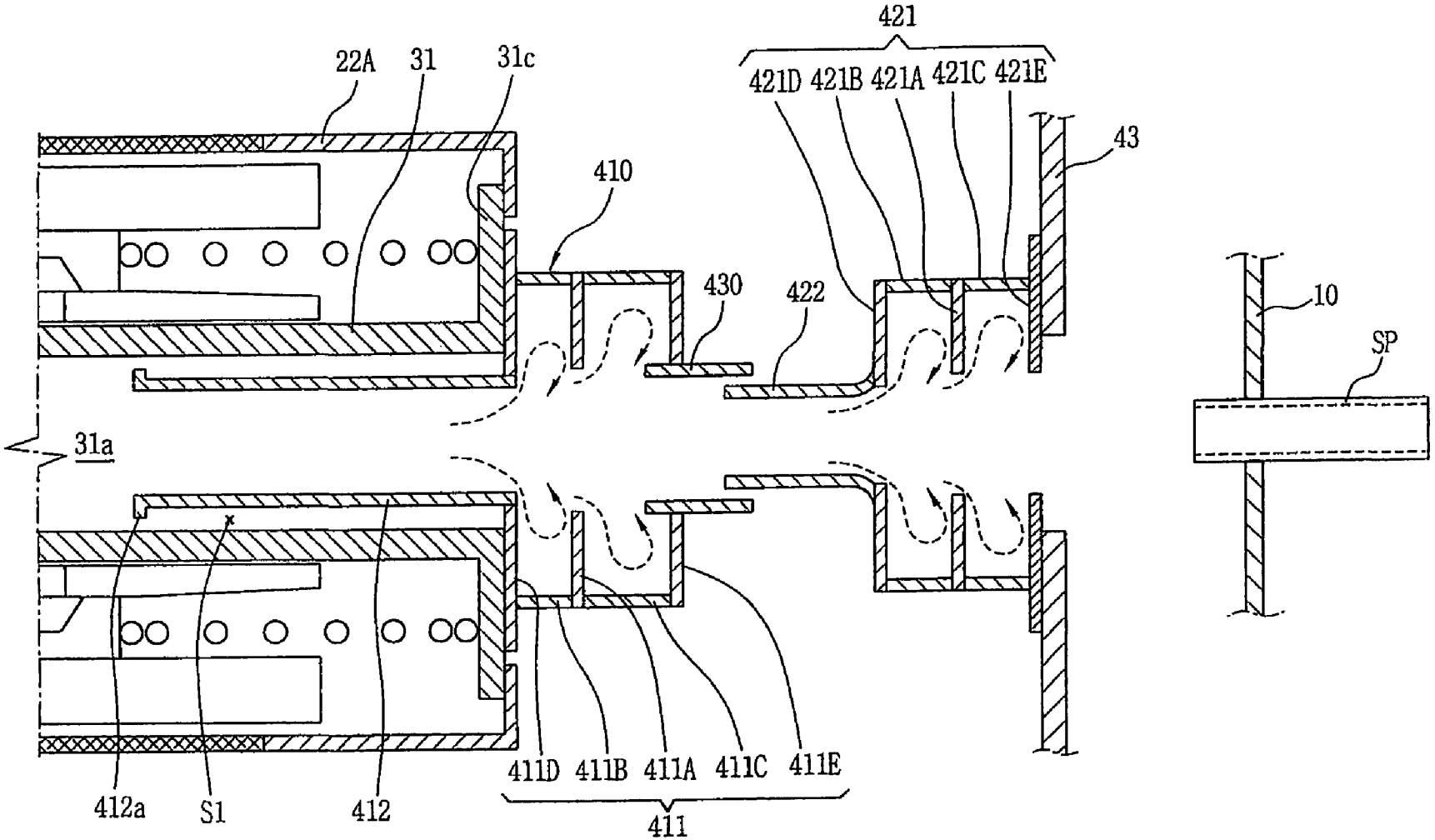
FIG. 11 is a transverse cross-sectional view showing an another embodiment of the suction gas guide system of the reciprocating compressor according to the present invention.

On the other hand, the gas guide unit may include a plurality of large conduit unit as shown in FIGS. 10 and 11.

That is, the embodiment shown in FIG. 10 includes a second large conduit unit 421 formed on one side of the second guide conduit 420 in the embodiment shown in FIG. 9. In that case, the second large conduit unit 421 is assembled in same way as that of the large conduit unit 411 of the first guide conduit 410, that is, the baffle unit 421A, the first conduit unit 421B, the second conduit unit 421C, the first side plate unit 421D, and the second side plate unit 421E are coupled by assembling them after separately molded.

Herein, the second guide conduit 420 includes the second large conduit unit 421 and a second small conduit unit 422 as described above, and the first conduit unit 421B and the first side plate unit 421D of the second large conduit unit 421 are formed as a single body, if necessary, and the other components may be coupled by using the ultrasonic welding or brazing. Also, it is desirable that the inner edge of the entrance of the second small conduit unit 422 is formed roundly.

On the other hand, as shown in FIG. 11, the first guide conduit 410 may include a first small conduit unit 412 inserted inside of the piston 31 on the front side.

In that case, it is desirable that the outer diameter of the first small conduit unit 412 is formed shorter than the inner diameter of the inner flowing passage 31*a* so that the above-described resonant space (S1) is able to be located between the outer circumference of the first small diameter unit 412 and the inner flowing passage 31*a* of the piston 31.

Also, it is desirable that an outward flange unit 412*a* is formed on end of the first small conduit unit 412 so that the efficiency of the resonant space (S1) can be increased.

Also, the middle guide conduit 430 and the second guide conduit 420 may be disposed conversely.

As described above, in case of the embodiments shown in FIGS. 10 and 11, the first large conduit unit 410 and the second large conduit unit 421 attenuate the noise, whereby the noise is reduced more efficiently. In particular, as shown in FIG. 11, the small conduit unit 412 is inserted into the inner flowing passage 31*a* of the piston 31, whereby forming the resonant space (S1) with the piston 31. Therefore the noise of low frequency is able to be reduced in the resonant space (S1), whereby the efficiency of reducing noise can be increased more.

In addition to the effect described above, the present embodiment has same structure and effects as those of the embodiments described earlier, and the detailed descriptions for that are omitted.

INDUSTRIAL APPLICABILITY

As described above, in the suction gas guide system for the reciprocating compressor according to the present invention, the gas guide conduit having both ends installed on the suction pipe of the shell and on the inner flowing passage of the piston facing each other and having the resonant space, is installed on same axial line so that the sucked gas inside the shell through the suction pipe is guided to the inner flowing passage of the piston disposed on inner side of the motor, whereby the refrigerant gas is sucked smoothly into the inner flowing passage through the gas guide conduit, and therefore the suction rate of the refrigerant gas is increased. In addition, the noise and vibration generated during suction of the refrigerant gas is attenuated in the resonant space and therefore the flow resistance against the sucked gas is reduced, whereby the efficiency and the reliability of the compressor is increased.

Also, the pre-heating of the refrigerant gas being sucked into the shell by the motor is prevented, and the specific volume of the refrigerant gas is not increased, whereby the efficiency of the compressor is able to be increased.

Also, the gas guide conduit is assembled after the components are molded, and therefore the assembling process of the gas guide conduit is easy to be performed, whereby the productivity is able to be increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

The invention claimed is:

1. A reciprocating compressor comprising:

a shell in which a suction pipe and a discharge conduit are communicated;

a reciprocating motor comprising a stator which includes an inner stator and an outer stator installed inside the shell with a certain air gap, and an armature disposed in the air gap between the two stators, the armature for undergoing reciprocating movement;

a compressor unit including a piston coupled to the armature of the reciprocating motor for undergoing reciprocating movement together with the armature, and having an inner flowing passage formed penetrating inside, and a cylinder supported inside of the reciprocating motor so that the piston is inserted into the cylinder slidably;

a frame unit supporting the reciprocating motor and the compressor unit;

a spring unit elastically supporting the armature of the reciprocating motor toward motion direction; and a suction gas guiding system including a gas guide conduit having a first end installed in the suction pipe and a second end in the inner flowing passage of the piston and guiding a sucked gas inside the shell to the inner flowing passage of the piston, and the guide conduit having a baffle unit, in which a bore of a certain size is formed.

2. The system according to claim 1, wherein the gas guide conduit is located at the same axial line as that of the suction pipe of the shell.

3. The system according to claim 1, wherein the gas guide conduit is formed to be inserted into the inner flowing passage of the piston partially or entirely.

4. The system according to claim 1, wherein a flange unit flanged toward inner surface of the inner flowing passage in the piston is formed on end of the gas guide conduit.

5. The system according to claim 1, wherein the gas guide conduit includes a first guide conduit extended toward inside of the inner flowing passage of the piston, and a second guide conduit extended toward the frame located between the piston and the suction pipe so as to communicate with the first guide conduit.

6. The system according to claim 5, wherein a large conduit unit, in which the diameter is enlarged, is included at least on one of those the first and second guide conduits.

7. The system according to claim 5, wherein one of those first and second guide conduits is inserted into the other conduit so as to be overlapped in a certain range.

8. The system according to claim 5, wherein the first guide conduit is fixed on the piston, the second guide conduit is fixed on the frame located between the piston and the suction pipe, and one of those first and second guide conduits is inserted into the other conduit so as to be overlapped with the other conduit in a certain range.

9. The system according to claim 7, wherein the first guide conduit is formed to be inserted into the second guide conduit.

10. The system according to claim 6, wherein the baffle unit having the bore of the certain size is formed inside the large conduit unit.

11. The system according to claim 10, wherein the baffle unit is formed on one of the first and second guide conduits, which has larger inner diameter than that of the other guide conduit respectively.

12. A reciprocating compressor comprising:

a shell in which a suction pipe and a discharge conduit are communicated;

a reciprocating motor comprising a stator which includes an inner stator and an outer stator installed inside the shell with a certain air gap, and an armature disposed in the air gap between the two stators, and the armature for undergoing reciprocating movement;

a compressor unit including a piston coupled to the armature of the reciprocating motor, undergoing reciprocating movement together with the armature, and having an inner flowing passage formed penetrating inside, and a cylinder supported inside of the reciprocating motor so that the piston is inserted into the cylinder slidably;

a frame unit supporting the reciprocating motor and the compressor unit;

a spring unit elastically supporting the armature of the reciprocating motor toward motion direction; and a suction gas guiding system including a first guide conduit communicated to the inner flowing passage of the piston, and a second guide conduit communicated to a bore of the frame disposed between the inner flowing passage and the suction pipe among the frame unit, at least one of the first guide conduit and the second guide conduit including a large conduit unit having larger inner diameter than that of the other, and a baffle unit having a bore of a certain size further included inside the large conduit unit.

13. The system according to claim 12, wherein a part or entire second guide conduit is inserted inside the first guide conduit and is overlapped with the first guide conduit.

14. The system according to claim 12, wherein the bore in the baffle unit has a diameter same as outer diameter of the second guide conduit.

15. The system according to claim 12, wherein the inner diameter of the large conduit unit is larger than that of the inner flowing passage of the piston.

16. The system according to claim 6, wherein a flange unit for supporting the spring unit is formed on one of the first guide conduit or the second guide conduit.

17. The system according to claim 12, wherein the first guide conduit is inserted into the second guide conduit.

18. The system according to claims 1, 2, or 12, wherein a flange unit is formed on those guide conduits, coupled to the frame between the piston and the suction pipe or to the piston, and the other guide conduits are fixed centering around the guide conduit fixed on the frame or on the piston.

19. The system according to claims 6, 10, 12, or 15, wherein the large conduit unit includes a cylindrical conduit unit; and a first side plate unit and a second side plated unit which are connected to the both ends of the outer circumference of the conduit unit and have bores with smaller inner diameter than that of the conduit unit; and one of the first and second side plate units is molded with the conduit unit as a single body.

20. The system according to claim 19, wherein one of the first and second side plate units is coupled to the conduit unit by using ultrasonic welding or brazing method.

21. The system according to claims 6, 10, 12, or 15, wherein the large conduit unit is fixed on the frame facing the suction pipe of the shell.

22. The system according to claims 1, 2, 4, 5, 8, 12, 14, or 15, wherein the guide conduits are disposed to be located on same axial line.

* * * * *